United States Patent [19]

Berney

[11] 3,955,352

[45] May 11, 1976

[54] ELECTRONIC WATCH WITH DIGITAL DISPLAY HAVING A CORRECTION MECHANISM FOR SMALL ERRORS

[76] Inventor: Jean-Claude Berney, Chemin de la Croix-Rouge 2, Lausanne, Switzerland

[22] Filed: Jan. 31, 1974

[21] Appl. No.: 438,456

[30] Foreign Application Priority Data

Feb. 1, 1973 Switzerland ..... 1419/73

[52] U.S. Cl. ..... 58/23 R; 58/85.5

[51] Int. Cl.[2] ..... G04C 3/00

[58] Field of Search ..... 58/23 R, 33, 50 R, 23 A, 58/34, 85.5

[56] References Cited

UNITED STATES PATENTS

| | | | |
|---|---|---|---|
| 3,596,462 | 8/1971 | Hayes | 58/50 R |
| 3,672,155 | 6/1972 | Bergey et al. | 58/50 R |
| 3,678,680 | 7/1972 | Fujita | 58/23 R |
| 3,699,763 | 10/1972 | Zeph | 58/23 R |
| 3,795,098 | 3/1974 | Fujita | 58/33 |
| 3,889,460 | 6/1975 | Yasukawa et al. | 58/85.5 X |

*Primary Examiner*—Ulysses Weldon

*Attorney, Agent, or Firm*—Haseltine, Lake & Waters

[57] ABSTRACT

An electronic watch comprising a precision resonator and oscillator connected to a frequency divider which produces impulses of 1 $H_z$. Connected to the frequency divider in sequence is a seconds counter, a minutes counter, an hour counter and possibly a day counter. An electronic means serves for displaying the state of the counter, and a microswitch including an actuator activated externally of the watch by finger pressure, acts to reset the seconds counter to zero and acts concurrently on all or part of the divider, independently of the minutes and hours counters, the actuator being isolated from or combined with the normal device to reset the time or correct the date. The seconds counter is constructed as a series of counter units, the last of which is a binary counter and all of the units are reset to zero when the switch is closed. In this way errors of thirty seconds or less can be corrected by acting on the actuator.

5 Claims, 3 Drawing Figures

ELECTRONIC WATCH WITH DIGITAL DISPLAY HAVING A CORRECTION MECHANISM FOR SMALL ERRORS

BACKGROUND a. Field of the Invention

The invention relates to electronic watches having a digital display and particularly to such watches with a correction mechanism for correcting small errors.

b. Prior Art

There are currently known electronic watches with digital displays which comprise an oscillator, a frequency divider, a seconds counter, a minutes counter, an hour counter, possibly a day counter and means for displaying the state of the counters, as well as means for resetting the time. These time resetting means are rather complicated and the user cannot easily avoid making errors. Because of this, the tendency is often to leave the watch alone when the error is small. However, a quartz oscillator provides a very great precision for the watch. The errors to be corrected are therefore, in practice, always less than 30 seconds except at the time of change of the battery. It therefore could be welcome if the user could easily correct errors of less than 30 seconds.

SUMMARY OF THE INVENTION

An object of the invention is to provide an electronic watch with digital display of the described type with means for easily correcting small errors of the order of 30 seconds or less.

The invention is directed to an electronic watch comprising a precision resonator, an oscillator, a frequency divider, a seconds counter, a minutes counter, an hour counter, possibly a day counter, electronic means for displaying the state of the counters, means for resetting the time, and the invention is characterized by the provision of a microswitch including an actuator activated externally of the watch by finger pressure, even when the watch is worn, said switch acting to reset the seconds counter to zero and concurrently to reset the divider, independently of the minutes and hours counters, said actuator being isolated from or combined with the normal means to reset the time or correct the date.

DETAILED DESCRIPTION

Figure 1:
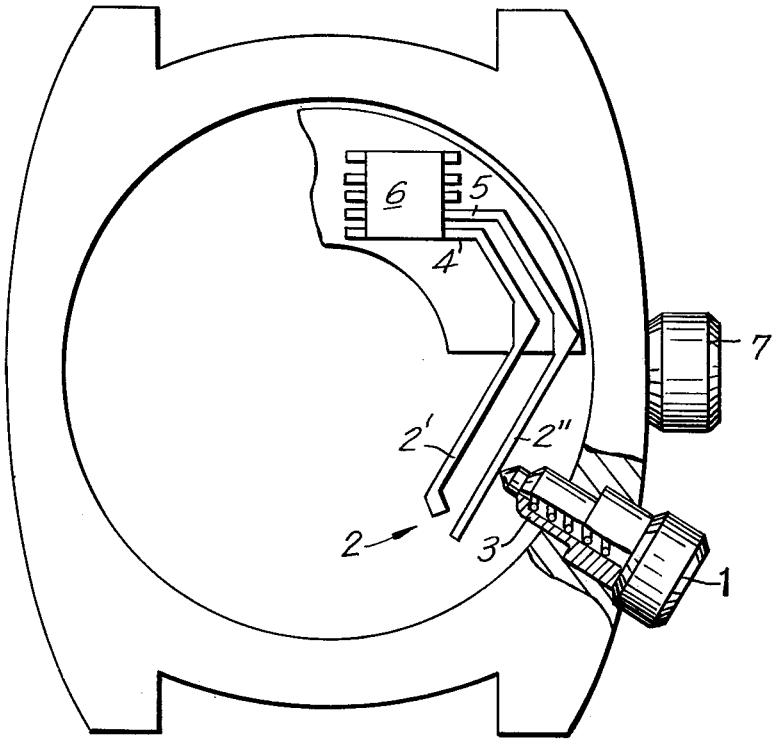
FIG. 1 is a diagrammatic illustration of a watch, partly in section, showing the disposition of the actuator.

Referring to FIG. 1 of the drawing, therein is seen a pushbutton 1 acting to close the blades 2'2'' of a switch 2. The pushbutton is subjected to the action of a spring 3 which urges the pushbutton to an initial position in which switch 2 is open when there is no finger pressure on pushbutton 1. The switch is connected between a power source 4 such as a replaceable battery and one of the terminals of an electronic circuit 6 which will be described in detail hereinafter with reference to FIGS. 2 and 3. The watch includes a stem 7 for setting the time displayed by the watch. It is within the contemplation of the invention to construct the stem 7 to operate in the manner of pushbutton 1 thus combining the two functions.

Figure 2:
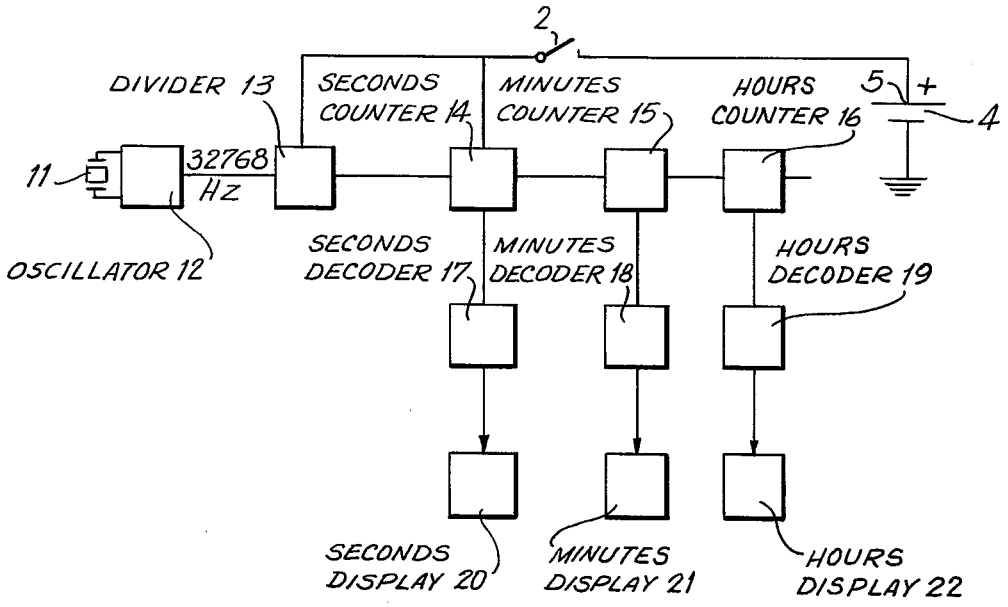
FIG. 2 is a schematic block illustration of the electronic circuit of the watch.

The circuit illustrated in FIG. 2 comprises a quartz crystal 11 having a resonant frequency of 32,768 $H_z$ and an oscillator 12 coupled to the crystal. A frequency divider 13 with a frequency division of 32,768 is connected to oscillator 12 and produces an output of 1 $H_z$. A second counter 14 delivers impulses of 1 minute to a minutes counter 15 which delivers impulses every hour to an hours counter 16, which may deliver impulses every 24 hours to a day counter when such is employed. Essentially, the counters 14 and 15 are sixty counters and the counter 16 is a twenty-four counter. There is further provided a seconds decoder 17 attached to a seconds display 20, a minutes decoder 18 attached to a minutes display 21 and an hours decoder 19 attached to an hours display 22. The construction up to this point is conventional. The switch 2 controlled by the pushbutton 1 acts to connect the zero setter of the divider 13 and the zero setter of the seconds counter 14 to the positive terminal 5 of the battery 4 when the pushbutton 1 is depressed. This operation effects zero setting of the divider 13 and the seconds counter 14.

Figure 3:
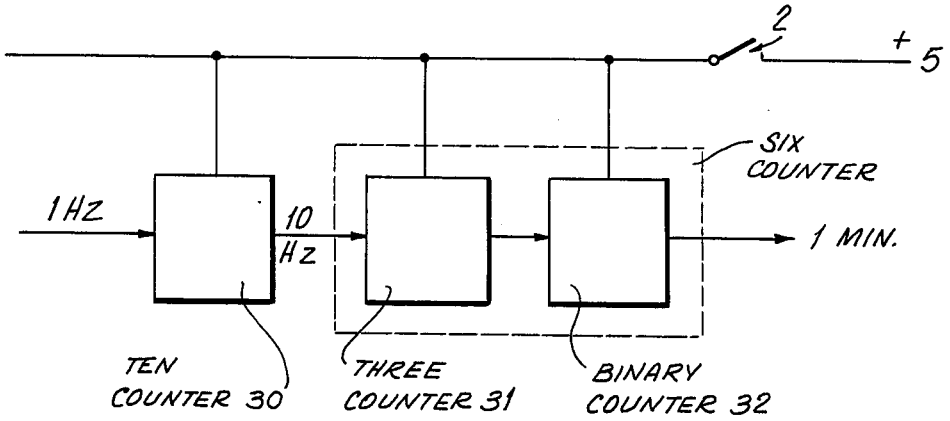
FIG. 3 is a schematic block illustration of the seconds counter of the watch.

Referring to FIG. 3 showing the detailed construction of the seconds counter, the seconds impulses are fed to a counter 30 which produces an output pulse for every ten input pulses and which is referred to hereafter as a ten counter. The ten counter 30 is connected to a six counter constituted by a three counter 31 connected to a binary counter 32. In FIG. 3 the decoders and displays are not illustrated as they do not participate in the operation. Switch 2 effects resetting to zero of the counters 30, 31 and 32 when the pushbutton 1 is depressed. The binary counter 32 has two simple states 0 and 1. When it passes from 1 to 0 it delivers an impulse which will be counted by the minute counter 15 and will modify the state of the latter. The resetting to zero produced by the closing of switch 2 puts or maintains the counter 32 in the 0 state. When the seconds display indicates a value between 00 and 29, the binary counter 32 is in 0 state. If a resetting to zero is effected, at this instant, it stays in this state and does not deliver any impulses to the minute counter 15 which remains in its state.

If, in contrast, the seconds display indicates a value between 30 and 59, the binary counter is in the 1 state and if it is reset to zero, it passes from the 1 state to the 0 state and delivers an impulse to the minutes counter which advances one unit.

The operation of the apparatus is as follows:

Assuming the watch to be running 15 seconds slow, and the user hears a radio time signal, for example, at twelve thirty, the watch at this instant reads 12h 29m and 45 sec. If the user instantaneously presses the pushbutton 1 when he hears the signal, the divider and the seconds counter will be reset to zero and the seconds counter will read 00. When the seconds counter passes from 45 (in fact any value between 30 and 59) to 00, a unit is added to the minutes display which passes to 30. At this instant of resetting of the time, the display passes from 12h, 29m, 45s to 12h, 30m, 00s which corresponds exactly to the time signal.

In the second case, it is assumed that the watch is 29 seconds fast. At the instant of the time signal of 12h, 30m, 00s, it will indicate a display of 12h, 30m, 29s. If the user presses the pushbutton, the display will pass from the above state to 12h, 30m, 00s since in passing from 29 to 00, the seconds counter does not supply an impulse to the minutes counter.

In the two cases, the resetting to the precise time is very simple as the user has only to press the pushbutton at the time signal.

It is observed that with a proper operating watch, its error need not exceed ±30 sec. If a precision of 0.5 sec each day is assumed, which is reasonable for a quartz crystal watch, the arrangement is utilized, at a minimum, once every 2 months (0.5 sec × 60 days = 30 sec).

Radio time signals may not always be convenient, and visual reference can be made to accurate clocks such as those at railroads, airports and the like, and the pushbutton is pressed when the second hand of the reference clock passes 60.

The arrangement is very advantageous as it enables the watch to provide exact time by an extremely simple operation in which it is only necessary to press the pushbutton with simple finger pressure when the watch is on the wrist.

What is claimed is:

1. An electronic watch having a digital display comprising means including an oscillator and a frequency divider connected to said oscillator for producing signals of 1 $H_z$, a seconds counter connected to said frequency divider, a minutes counter connected to said seconds counter, an hours counter connected to the minutes counter, electronic means connected to said counters for displaying the state of the counters and correction means operable independently of the minutes and hours counters to reset to zero the seconds counter and at least part of the frequency divider, said seconds counter including a plurality of counter units connected in series, the last unit being a binary counter which produces a pulse when the seconds counter is reset to zero to advance the minute counter by one unit when the watch is slow and to leave the minute counter alone when the seconds counter is reset to zero and the watch is fast whereby errors of thirty seconds or less can be corrected by operation of the correction means to reset the seconds counter to zero.

2. A watch as claimed in claim 1 wherein said correction means comprises a pushbutton actuated externally of the watch by simple finger pressure for resetting to zero said seconds counter and said frequency divider.

3. A watch as claimed in claim 2 wherein said watch includes a battery, said correcting means including a switch connected between said battery and said frequency divider and said seconds counter, said pushbutton acting to close said switch when depressed.

4. An electronic watch as claimed in claim 3 wherein all said counter units of the seconds counter are being connected to said switch for reset to zero when the switch is closed.

5. An electronic watch as claimed in claim 4 wherein the first counter unit of the seconds counter is a ten counter, a second counter unit is a three counter and the last unit is said binary counter, the three counter and binary counter forming a six counter.

* * * * *